US011602214B2

(12) United States Patent
Nakamura et al.

(10) Patent No.: US 11,602,214 B2
(45) Date of Patent: Mar. 14, 2023

(54) BRUSH TIP FOR COSMETIC APPLICATOR, METHOD FOR MANUFACTURING SAME AND COSMETIC APPLICATOR USING SAME

(71) Applicant: MITSUBISHI PENCIL COMPANY, LIMITED, Tokyo (JP)

(72) Inventors: Hitoshi Nakamura, Fujioka (JP); Satoshi Sakuma, Fujioka (JP); Takashi Umeno, Fujioka (JP); Hiroshi Satou, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 383 days.

(21) Appl. No.: 16/955,994

(22) PCT Filed: Dec. 19, 2018

(86) PCT No.: PCT/JP2018/046792
§ 371 (c)(1),
(2) Date: Jun. 19, 2020

(87) PCT Pub. No.: WO2019/124440
PCT Pub. Date: Jun. 27, 2019

(65) Prior Publication Data

US 2020/0405044 A1 Dec. 31, 2020

(30) Foreign Application Priority Data

Dec. 20, 2017 (JP) ..... JP2017-243656
Aug. 3, 2018 (JP) ..... JP2018-146957

(51) Int. Cl.
*A46B 9/06* (2006.01)
*A45D 34/04* (2006.01)

(52) U.S. Cl.
CPC ..... *A46B 9/065* (2013.01); *A45D 34/042* (2013.01); *A45D 2200/10* (2013.01); *A45D 2200/20* (2013.01); *A46B 2200/1046* (2013.01)

(58) Field of Classification Search
CPC .. A45D 34/042; A45D 34/043; A45D 34/045; A45D 40/262; A45D 40/264;
(Continued)

(56) References Cited

U.S. PATENT DOCUMENTS 4,940,351 A * 7/1990 Konose ..... A45D 34/042 401/278
6,688,796 B1 * 2/2004 Liu ..... A45D 34/042 401/172

(Continued)

FOREIGN PATENT DOCUMENTS

JP 04-7181 U1 1/1992
JP 04-60482 U 5/1992

(Continued)

OTHER PUBLICATIONS

International Search Report for corresponding Application No. PCT/JP2018/046792, dated Feb. 26, 2019.

(Continued)

*Primary Examiner* — David J Walczak
(74) *Attorney, Agent, or Firm* — Renner, Otto, Boisselle & Sklar, LLP

(57) ABSTRACT

A brush tip for a cosmetic applicator which is hygienic by preventing the growth of bacteria and other germs in the area of the brush tip not impregnated with the application fluid, as well as the manufacturing method of the brush tip and a cosmetic applicator using the brush tip. This brush tip for a cosmetic applicator includes brush tip filaments and serving as an applying part of the cosmetic applicator having a cosmetic storage for storing a cosmetic fluid, with the rear (Continued)

end of the brush tip attached to the front end of the cosmetic storage. The brush tip incorporates a discharge port that communicates with the cosmetic storage of the cosmetic applicator, and a coating of an antimicrobial agent is formed on the surface of the brush tip filaments, located behind the discharge port inside the brush tip.

17 Claims, 3 Drawing Sheets

(58) Field of Classification Search
CPC ..... A45D 40/265; A45D 2200/10; A45D 2200/20; A46B 9/065; A46B 17/065
USPC ..... 401/269, 282, 286, 287
See application file for complete search history.

(56) References Cited

U.S. PATENT DOCUMENTS

| | | | | |
|---|---|---|---|---|
| 2003/0035953 | A1 | 2/2003 | Weihrauch | |
| 2005/0244440 | A1 | 11/2005 | Nakamura | |
| 2008/0016637 | A1 | 1/2008 | Lim | |
| 2015/0065927 | A1 | 3/2015 | Brewer | |
| 2015/0098746 | A1* | 4/2015 | Thompson | A45D 40/205 401/68 |
| 2018/0369081 | A1 | 12/2018 | Sakuma | |

FOREIGN PATENT DOCUMENTS

| | | | |
|---|---|---|---|
| JP | 08-230385 | A | 9/1996 |
| JP | 2000-041730 | A | 2/2000 |
| JP | 2003-010342 | A | 1/2003 |
| JP | 2005-323953 | A | 11/2005 |
| JP | 3143336 | U | 7/2008 |
| JP | 2009-285445 | A | 12/2009 |
| JP | 2010-51593 | A | 3/2010 |
| JP | 2014-87637 | A | 5/2014 |
| JP | 2016-87289 | A | 5/2016 |
| JP | 2016-529038 | A | 9/2016 |
| WO | 2017/110872 | A1 | 6/2017 |

OTHER PUBLICATIONS

Extended European Search Report for corresponding EP Application No. 18890852.9 dated Aug. 10, 2021.

* cited by examiner

BRUSH TIP FOR COSMETIC APPLICATOR, METHOD FOR MANUFACTURING SAME AND COSMETIC APPLICATOR USING SAME

TECHNICAL FIELD

The present invention relates to a brush tip for a cosmetic applicator using a fiber material having antibacterial properties, a method for manufacturing the brush tip, and a cosmetic applicator using the brush tip. More specifically, without regard to what the fiber material is made of, such as a resin filament, animal hair and the like, the present invention relates to a brush tip for a cosmetic applicator excellent in applicability and excellent in regard to antiseptic properties related to cosmetics, a method for manufacturing the brush tip, and a cosmetic applicator using the brush tip.

BACKGROUND ART

Conventionally, animal hair such as squirrel hair, horse hair and goat hair, has been used as the hair material of a brush for a cosmetic applicator, and these animal hairs presents good skin contact, that is, a good feeling of application. It is also said that these hairs have good liquid containing properties and transferability (dischargibility).

However, though animal hairs have the above-mentioned advantages, they have drawbacks such as limited supply because they are natural resource. Accordingly, in recent years, brush fiber materials for cosmetics made from synthetic fibers have been proposed as the alternatives to animal hairs. In addition, prior art technologies have been disclosed in which antifungal and antibacterial measures are applied to these brush tips.

For example, Patent Document 1 discloses a brush tip made of an animal hair coated or applied with an antibacterial or antiseptic agent. Since the brush is left wet and unsealed without any cap or the like whether or not the user washes the brush after using it for calligraphy or drawing, this configuration is aimed at preventing the brush from thinning and losing hair due to proliferation of germs such as bacteria, etc., which feed on the proteins and glue of the Chinese ink. The disclosure of Patent Document 1 is intended to prevent deterioration of the brush that is stored in an open place, and is not aimed at preventing putrefaction inside the cosmetic brush that is preserved as is, containing the cosmetic fluid with the saliva and tears of the user.

Patent Document 2 points out a problem of poor hygiene due to generation of mold when the brush is sealed with a cap or the like while being wet as described above because the water evaporates slowly so that a considerable time is required for drying. In order to prevent this, the document discloses that a vent is provided in the cap and another vent is provided in the front barrel to promote drying of the applying part. However, it is difficult to complete the drying of the applying part even this manipulation, especially in the part covered by the front barrel because evaporation of water is very slow due to smallness of the vent. Depending on the surrounding conditions, an outbreak of germs may occur before the evaporation is complete.

Patent Document 3 discloses a writing tool cap having a felt piece that contains an antibacterial agent and comes in contact with the pen tip when the cap is attached to pen body so as to present an excellent antibacterial and antifungal effect. With this configuration, from the very first the pen tip will not be left open except the cap being forgotten to be to put on. In addition, even if fungal spores floating in the air adhere during use, it is possible to prevent the growth of fungi by the felt piece impregnated with the antibacterial agent. Further, even when water condensation accumulates in the cap after the ink solvent (water) repeatedly evaporates and condenses due to the rise and fall of the outside air temperature, germs such as bacteria cannot propagate because the felt piece is impregnated with the antibacterial agent.

However, since this configuration is effective only when the pen tip has a certain degree of hardness and can be pressed against the felt piece, it is not suitable for a weak flexible tip such as a so-called brush tip. Though this disclosure shows the antiseptic effect on the ink, but it differs from the antiseptic measures of the cosmetic brush, which retains the cosmetic fluid including the saliva and tears of the user in the brush after the start of use.

Patent Document 4 discloses an antibacterial cosmetic brush manufactured by kneading silver-containing antibacterial inorganic particles into a bristle material such as polytrimethylene terephthalate. Since the brush disclosed herein is manufactured by kneading antibacterial inorganic particles into a resin bristle material, the filament may be easily broken. Thus this method involves various manufacturing downsides such as the kneaded amount of the antibacterial inorganic particles cannot be increased. In addition, the filament kneaded with antibacterial inorganic particles shows degradation of the tensile strength and stretch modulus, which are the properties of the filament, as compared with the filament formed without antibacterial inorganic particles, so that the desired brush characteristics are difficult to achieve. Further, there is a case where the effect cannot be exerted on all the various germs which may proliferate in the brush after the start of use.

Patent Document 5 discloses a brush tip whose rear end is bound by a thread or the like which is coated, kneaded, or impregnated with a ceramic that radiates far-infrared rays so that radiation of the far-infrared rays from the thread can implement sterilization treatment. Since this method needs use of a substance such as water or ethanol that easily absorbs far-infrared rays, the effect is poor when using a non-aqueous solvent. Also, this method is effective on only a few germs and is not suitable for saliva which contains a large amount of germs.

PRIOR ART DOCUMENTS

Patent Documents

Patent Document 1:
Japanese Laid-Open Utility Model Publication No. 04-7181 (full specification, Problems to be solved by the invention, Operation, etc.).
Patent Document 2:
Japanese Laid-Open Patent Publication No. 2016-87289 (Claims, Modes for carrying out the invention, etc.).
Patent Document 3:
Japanese Laid-Open Patent Publication No. 08-230385 (claims, etc.).
Patent Document 4:
Japanese Laid-Open Patent Application No. 2014-87637 (Abstract, Claims, etc.).
Patent Document 5: Japanese Laid-Open Utility Model Publication No. 04-60482 (full specification, Examples, FIG. 2, etc.).

SUMMARY OF THE INVENTION

Problems to be Solved by the Invention

The present invention has been devised to solve the above-described drawbacks of the prior art, it is therefore an object of the present invention to provide a brush tip used as an applying part of a cosmetic applicator, which is excellent in applicability of the cosmetic and excellent in antiseptic properties inside the brush tip, especially in antibacterial property during use, as well as providing a method for manufacturing the same, and a cosmetic applicator using the same.

Means for Solving the Problems

The present inventors hereof have conducted intensive studies in order to solve the above problems, and surprisingly have found that formation of a film of an antibacterial agent by coating an antibacterial agent solution at a predetermined concentration over, at least, the rear brush filaments in which a cosmetic fluid is hard to permeate, prevents germs from propagating in the cosmetic permeating the brush, for a long period of time. It has also been found that this treatment makes it difficult for the antibacterial agent film to come off or to be lost, and enables smooth application to the end of life. It has been further found that the saliva and the like, as a result of use, do not cause propagation of germs at the rear part of the brush, where the cosmetic fluid is difficult to permeate. Thus, they have completed a brush tip for a cosmetic applicator aimed at the above purpose as well as a manufacturing method and the cosmetic applicator using this.

That is, the present invention is as follows.

(1) A brush tip for a cosmetic applicator of the present invention includes brush tip filaments and serving as an applying part of the cosmetic applicator having a cosmetic storage for storing a cosmetic fluid, with the rear end of the brush tip attached to the front end of the cosmetic storage, and is characterized in that: the brush tip incorporates a discharge port that communicates with the cosmetic storage of the cosmetic applicator; and a coating of an antimicrobial agent is formed on the surface of the brush tip filaments, located at least behind the discharge port inside the brush tip.

It is preferable that the antibacterial agent is contained in the brush tip filaments.

Further, a brush tip for a cosmetic applicator of the present invention includes brush tip filaments and serving as an applying part of the cosmetic applicator having a cosmetic storage for storing a cosmetic fluid, with the rear end of the brush tip attached to the front end of the cosmetic storage, and is characterized in that: the brush tip incorporates a discharge port that communicates with the cosmetic storage of the cosmetic applicator; and an antibacterial agent is kneaded with the brush tip filaments, located at least behind the discharge port inside the brush tip so as to make the antibacterial agent contain in the resin filaments.

It is preferable that the antibacterial agent is solid at normal temperature.

(2) A cosmetic applicator of the present invention is an cosmetic applicator having a brush tip includes brush tip filaments and serving as an applying part of the cosmetic applicator having a cosmetic storage for storing a cosmetic fluid, with the rear end of the brush tip attached to the front end of the cosmetic storage, and is characterized in that the brush tip incorporates a discharge port that communicates with the cosmetic storage of the cosmetic applicator, and a coating of an antimicrobial agent is formed on the surface of the brush tip filaments, located at least behind the discharge port inside the brush tip.

A cosmetic applicator of the present invention is an cosmetic applicator having a brush tip, including brush tip filaments and serving as an applying part of the cosmetic applicator having a cosmetic storage for storing a cosmetic fluid, with the rear end of the brush tip attached to the front end of the cosmetic storage, and is characterized in that the brush tip incorporates a discharge port that communicates with the cosmetic storage of the cosmetic applicator, and an antibacterial agent is kneaded with the brush tip filaments, located at least behind the discharge port inside the brush tip so as to make the antibacterial agent contain in the resin filaments.

It is preferable that the viscosity of the cosmetic fluid stored in the cosmetic applicator is 50 mPa·s or more as measured at 25° C. at a shear rate of 3.83 $s^{-1}$ by a cone plate viscometer.

It is preferable that the brush tip of the applying part of the cosmetic applicator is covered with a cap.

It is preferable that the cap includes a vent communicating between the inside of the cap and the outside of the cap.

It is preferable that the outer periphery of the rear part of the brush tip is covered by a front end part of the cosmetic applicator.

(3) A manufacturing method of a brush tip for a cosmetic applicator of the present invention is a manufacturing method of a brush tip for a cosmetic applicator of animal hair fibers or resin filaments, and at least comprises: a step of immersing at least the rear end on the distal direction of the animal hair fibers, or at least the rear end of the resin filaments, in a solution in which an antibacterial agent is dissolved in a solvent capable of dissolving the antibacterial agent; a step of drying and removing the solvent after immersing; and a step of bunching a fiber bundle of the animal hair fibers or the resin filaments from which the solvent has been removed.

A manufacturing method of a brush tip for a cosmetic applicator of the present invention is a method for manufacturing a brush tip for a cosmetic applicator of animal haft fibers or resin filaments, and at least comprises: a step of bundling a fiber bundle of the animal hair fibers or the resin filaments to form a brush tip; a step of immersing at least the rear end of the brush tip in a solution in which an antibacterial agent is dissolved in a solvent capable of dissolving the antibacterial agent; and a step of drying and removing the solvent after immersing.

(4) A manufacturing method of a brush tip for a cosmetic applicator of the present invention is a manufacturing method of a brush tip for a cosmetic applicator of resin filaments, and comprises: a step of kneading an antibacterial agent in at least the rear end of the resin filaments; and a step of bundling the resin filaments after kneading into a fiber bundle.

It is preferable that the step of kneading the antibacterial agent at least in the rear end of the resin filaments is implemented by fusing the resin filaments with the antibacterial agent kneaded therein and resin filaments without an antibacterial agent, with respect to the longitudinal direction, and cutting the fused resin filaments so that the fused part is located at the approximate center.

It is preferable that the step of kneading the antibacterial agent at least in the rear end of the resin filaments is implemented by cutting down the front half of the resin filament with the antibacterial agent kneaded therein, so as to remove the antibacterial agent.

In the manufacturing methods (3) and (4) of a brush tip for a cosmetic applicator of the present invention, it is preferable that at least the front end of the resin filament is tapered.

In the manufacturing methods (3) and (4) of a brush tip for a cosmetic applicator of the present invention, it is preferable that the antibacterial agent is solid at normal temperature.

According to the present invention, the brush tip for a cosmetic applicator has a coating layer of an antibacterial agent on the surface of the rear part of filaments, the antibacterial agent gradually acts on the contaminated portion caused by germs and the like entering the brush and suppress the growth of bacteria, whereby it is possible to obtain excellent antibacterial effect and deodorizing effect.

In addition, in the brush tip for a cosmetic applicator having resin brush filaments with an antibacterial agent kneaded in the rear part thereof, the antibacterial agent gradually acts on the contaminated portion caused by germs and the like entering the brush and suppresses the growth of bacteria, whereby it is possible to obtain excellent antibacterial effect and deodorizing effect.

Furthermore, if the antibacterial agent used is solid particularly at normal temperature, the antiseptic or antibacterial effect lasts a long time, and it is possible to obtain a cosmetic applicator brush tip having more excellent antibacterial and deodorizing effects.

Since the cosmetic applicator of the present invention is provided with the brush tip for a cosmetic applicator having the above-described effects, the antibacterial agent gradually acts on the contaminated portion caused by germs and the like entering the brush and suppresses the growth of bacteria, hence the applicator is hygienic even when it is used bit by bit, and has no antibacterial agent coming off, so it is suitable for a cosmetic applicator that is used little by little every day.

The manufacturing method of a brush tip for a cosmetic applicator of the present invention has an advantage that a brush tip for a cosmetic applicator having the above-described effects can be efficiently and easily manufactured.

BEST MODE FOR CARRYING OUT THE INVENTION

Figure 1:
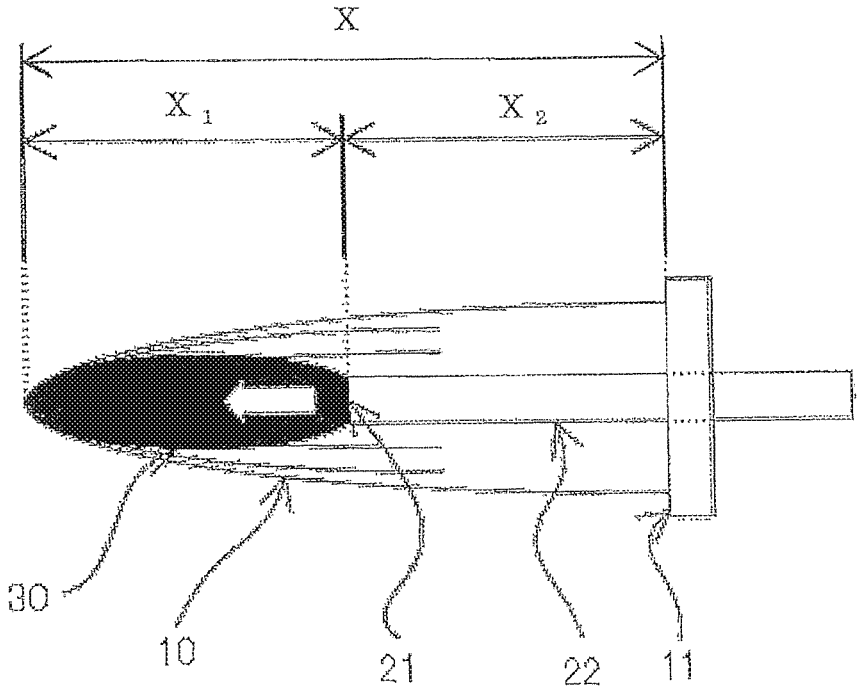
FIG. 1 shows an example of an embodiment of a brush tip for a cosmetic applicator according to the present invention and is a schematic diagram of the embodiment in which a high-viscosity cosmetic fluid is discharged from a discharge port in the brush toward the distal end of the brush tip. This drawing shows a state where the peripheral side of the brush is not covered with a front end of the barrel (so-called front barrel) of the cosmetic applicator.

Hereinafter, each embodiment of a brush tip for a cosmetic applicator of the present invention, a method for manufacturing the same and a cosmetic applicator using the same will be described in detail.

(Cosmetic Applicator Brush Tip)

The brush tip for a cosmetic applicator according to the present invention includes brush tip filaments and serves as an applying part of the cosmetic applicator having a cosmetic storage for storing a cosmetic fluid, with the rear end of the brush tip attached to the front end of the cosmetic storage. The brush tip incorporates a discharge port that communicates with the cosmetic storage of the cosmetic applicator, and a coating of an antibacterial agent is formed on the surface of the brush tip filaments, located at least behind the discharge port inside the brush tip.

Further, the brush tip for a cosmetic applicator according to the present invention includes brush tip filaments and serves as an applying part of the cosmetic applicator having a cosmetic storage for storing a cosmetic fluid, with the rear end of the brush tip attached to the front end of the cosmetic storage. The brush tip incorporates a discharge port that communicates with the cosmetic storage of the cosmetic applicator, and an antibacterial agent is kneaded with the brush tip filaments, located at least behind the discharge port inside the brush tip so as to make the antibacterial agent contain in the resin filaments.

(Filament)

The brush tip filaments able to be used in the present invention are, for example, resin filaments, animal hair fibers and the like, and these may be used alone or in combination (mixed hair).

In the cosmetic applicator brush tip of the present invention, when, for example, resin filaments or the like are used, specifying the diameter (φ) of the filament at 45 to 150 μm, particularly about 45 to 80 μm as thick as that of animal hair fiber (e.g., squirrel hair), makes it possible to produce a very excellent feeling similarly to squirrel hair when used for cosmetic hair material. The filament used for a flat brush for stage makeup is as thick as about 150 μm because of the need for strong elasticity. The thickness of the filament should be appropriately selected while considering the balance between the feeling of use and the elasticity strength.

The diameter (φ) of the filament for the brush (animal hair fiber, resin filament) used is 45 μm to 150 μm. The resin filament does not need to be tapered toward the distal end, but preferably has a tapered end in terms of feeling of use and application.

(Animal Hair Fiber)

When animal hair fibers are used as the filament for the brush tip, the animal hair fibers of raccoon dogs, sheep, horses, weasels, cats, rabbits and the like may be used alone or in combination of two or more kinds, and the rear ends are bound by a yarn while heating to manufacture a brush tip. Needless to say, it is also possible to use a mixture of these animal hairs and synthetic resin fibers.

(Synthetic Resin Fiber)

As the resin filament used for the brush tip, examples of synthetic resin fiber materials may include: polyamide resins such as 6,6-nylon, 6-nylon, 12-nylon, 6,10-nylon, 6,12-nylon, etc.; polyolefin resins such as polyethylene and polypropylene; and polyester resins such as polyethylene terephthalate, polybutylene terephthalate and polytrimethylene terephthalate.

As the synthetic resin fibers, those having a diameter (φ) of 45 μm to 150 μm can present an appropriate elasticity as described above and also are effective in suppressing bending and breakage, hence can be preferably used as a brush. The more preferable diameter (φ) is 70 μm to 150 μm from the viewpoints of easy handling in production, conformable elasticity and feeling and the like.

The diameter (φ) herein is the diameter of the cylindrical portion (a portion where no tapered surface, described later, is formed). The synthetic resin fiber may have other sectional shapes than the circular shape, such as an elliptical shape, a star shape, a cocoon shape, a cross shape and a polygonal shape.

The number of the brush filaments (animal hair fibers, synthetic resin fibers constituting the resin filaments) to be used can be set as appropriate, depending on the utility of the cosmetic applicator. When a cosmetic applicator is needed for application to a medium-sized area such as a lip, one that usually has 500 to 800 filaments embedded can be preferably used. When a cosmetic applicator is needed to draw relative thin lines such as eyeliners, one that usually has 200 to 400 fibers embedded can be preferably used.

Further, when a synthetic resin fiber is used, the synthetic resin fibers constituting the brush may include tapered fibers (specific synthetic resin fiber) that are formed such that the diameter gradually decreases toward the distal end and the distal end is tapered and formed with a tapered surface. The length of the tapered surface of the tapered fiber is usually in the range of 0 to 13 mm from the distal end of the synthetic resin fiber.

The length (full length) of the brush filament (animal hair fiber, synthetic resin fiber forming the resin filament) varies from about 13 to 60 mm, depending on the kind of the cosmetic fluid, the utility of the cosmetic applicator and others.

(Antibacterial Agent)

As the antibacterial agent, any can be used as long as it is capable of being used for cosmetic fluids, can be applied to the filaments used for the brush tip, and can maintain its coating film or coating layer (antibacterial agent layer) or can form a coating film (antibacterial agent layer) of the antibacterial agent on the filament surface, and can retain an antibacterial agent inside the filament used for the brush tip as well as on the filament surface. In the present invention, the antibacterial agent should contain a preservative.

Specifically, the antibacterial agent may use at least one (each alone or a mixture of two or more) of the following substances: benzoic acid and its salts (alkali metal salts, amine salts, the same applies hereinafter), salicylic acid and its salts, sorbic acid and its salts, dehydroacetic acid and its salts, parahydroxybenzoate ester and its sodium salt, phenoxyethanol, trichlorohydroxydiphenylether, sodium lauryldiaminoethylglycine, resorcinol, isopropylmethylphenol, alkyldiaminoethylglycine hydrochloride, cetylpyridinium chloride, benzalkonium chloride, benzethonium chloride, orthophenylphenol, sodium orthophenylphenol, chlorhexidine gluconate, cresol, chloramine T, chloroxylenol, chlorphenesin, chlorhexidine and its salts, alkyl isoquinolium bromide, thymol, hinokitiol, zinc pyrithione, polyaminopropyl biguanide, methylisothiazolinone, iodopropynyl butylcarbamate, photosensitizer, isopropylmethylphenol, and alkanediols such as ethylhexylglycerin, pentanediol, hexanediol, octanediol, benzimidazole antibacterial agents such as benzimidazole, albendazole and purine, silver-containing glass, zinc oxide-containing glass, zinc sulfide, titanium oxide, and zirconium compound.

Preferably, those having low solubility in cosmetic fluids or saliva, and those selected from solids at normal temperature (25° C., the same applies hereinafter).

If the solubility in cosmetic fluids or saliva is low, the agent will be gradually dissolved in the liquid and the effect of the present invention can be maintained for a long time. Further, if the agent is solid at normal temperature, the coating film or the antibacterial layer can be maintained for a long time. Surprisingly, it was found that the antibacterial agents which are solid at normal temperature have excellent adhesion to the filament used, and also have excellent adhesive strength so as to be kept adhered and not to come off even when the filament is bent. As such an antibacterial agent, parahydroxybenzoate ester and its sodium, and chlorhexidine can be particularly mentioned.

These antibacterial agents are diluted in a solvent such as an organic solvent or water (purified water, distilled water, ion-exchanged water, pure water or the like), and the above-mentioned filaments or brush tip is immersed in the diluted solution (dipping treatment) and/or is subjected to coating treatment by spraying, electro deposition, grafting, primer processing, etc., to be able to achieve coating (deposition) of the antibacterial agent.

Examples of the organic solvent that can be used include volatile lower alcohols such as ethanol, propanol, butanol, isopropanol and isobutanol, ketones such as acetone, alkanes such as normal hexane, and butyl acetate and ethyl acetate. These can be used alone or two or more in combination. Preferably, ethanol is desirable in terms of safety, drying properties, odor and the like.

The higher the concentration of the antibacterial agent, the more densely the agent can be coated on the filament surface with a sufficient thickness. However, in the case of a solid antibacterial agent at room temperature, for example, parabens, the coated antimicrobial agent comes off with a slight force if the concentration of the diluent is 10 mass % or more, so that the expected antimicrobial effect often cannot be obtained. Rather, a concentration of about 5 mass % results in a preferable effect. Needless to say, if the concentration is too low, for example, 0.01 mass % or lower, the coating on the filament surface becomes insufficient, so that the expected antibacterial effect cannot be obtained. When a powder of the antibacterial agent is used, the powder can be dispersed instead of being diluted, and the above-mentioned filament or brush can be immersed in the dispersion to coat the antibacterial agent.

The concentration of the diluent (antibacterial agent) with the above solvent may and should be adjusted so that the agent will be coated in a predetermined amount described below, and is preferably 0.1 to 40 mass %, more preferably 0.1 to 10 mass %, and still more preferably 0.1 to 7 mass %, particularly preferably 0.5 to 5 mass %.

Further, when the dispersion contains a dispersant for keeping the powder of the antibacterial agent dispersed and a binder for keeping the coating of the antibacterial agent, the effect can be made more persistent.

As the example of the dispersant that can be used include, at least one of polyacrylic acid-based dispersants, nonionic surfactants, anionic surfactants and cationic surfactants can be listed. As the example of the binder that can be used, at least one of acrylic emulsions, acrylic acid ester copolymers and urethane can be mentioned. If an additive serves as both a dispersant and a binder, only the additive may be added. The concentration of the antimicrobial agent in the dispersion conforms to the concentration of the diluent described above.

On the other hand, by modifying the fiber surface by etching treatment, ultraviolet irradiation, etc., it becomes possible to maintain the coating of the antibacterial agent without using a binder.

Further, formation of the brush tip for a cosmetic applicator of the present invention by forming a coating film or a film (antibacterial agent layer) of the antibacterial agent on the filament surface in a predetermined portion, or the rear part thereof and filling an antibacterial agent inside the filaments used for the brush tip, may be performed by a method of impregnating an antibacterial agent solution under a high-temperature and high-pressure environment when, for example, an animal hair fiber is used. When a synthetic resin fiber for forming resin filaments is used, formation of the brush tip may be performed by kneading a resin material and an antibacterial agent at the time of preparing the synthetic resin fiber to compound the antibacterial agent in the whole resin filament, by kneading a resin material and an antibacterial agent to compound the antibacterial agent only in the rear part of resin filaments, by forming a fiber having a sheath-core cross-section by kneading an antibacterial agent in only the resin material for the sheath to make only the fiber surface contain the antibacterial agent, by forming a fiber having multiple layered cross section (side-by-side cross section) by kneading an antibacterial agent in part of resin material to make only part of the fiber surface contain the antibacterial agent, or other methods.

Since the configurations of the present invention include formation of a coating of the antibacterial agent on at least the surface of the filaments for the brush tip in the rear of the discharge port inside the brush, formation of the resin filament containing an antibacterial agent by kneading the antibacterial agent in the filaments for the brush tip at the rear of the discharge port inside the brush, and the like, as described above, the above-described immersion treatment and the kneading treatment to the resin are preferable.

Here in the present invention, in forming a coating etc. by the above immersion treatment and in performing immersion treatment and having the antibacterial agent contained in the filaments, the total amount of the antibacterial agent formed on the surface of the rear part of the brush tip filaments varies depending on the type of cosmetic fluid, and the size and structure of the cosmetic applicator. However, the function of the present invention can be sufficiently brought out when the amount of the antibacterial agent is specified to be about 0.1 to 10 mass %, preferably 0.5 to 10 mass %, more preferably 0.5 to 6 mass %, and particularly preferably 0.5 to 5 mass %, relative to the total weight of the brush tip filaments.

In the brush tip for a cosmetic applicator of the present invention, when, for example, a high-viscosity liquid lip gloss is used as a cosmetic fluid for the cosmetic applicator as shown in FIG. 1, contaminants such as saliva attached to the lips will penetrate into the portion of the brush tip 10 where the high-viscosity liquid lip gloss 30 hardly permeates, specifically, a rear part $X_2$ of the brush tip 10, which may proliferate germs and give out a foul odor. However, when this part is coated with an antibacterial agent, it is possible to suppress proliferation of the germs, hence produce an excellent deodorizing effect. In this case, when the high-viscosity liquid lip gloss 30, for the cosmetic fluid, is ejected from the cosmetic applicator to the interior of the brush tip 10 through the discharge port 21, the high-viscosity liquid lip gloss slowly permeates forward of the brush tip and hardly goes to the rear part of the brush tip 10, that is, to the rear ($X_2$) behind the discharge port 21. If saliva and the like infiltrate the portion where the liquid lip gloss 30 hardly permeates, the antibacterial agent usually blended as a formulation of the liquid lip gloss 30 becomes difficult to produce its effect, so that germs will propagate at the portion where saliva and the like have infiltrated, and generate foul odors.

Figure 2:
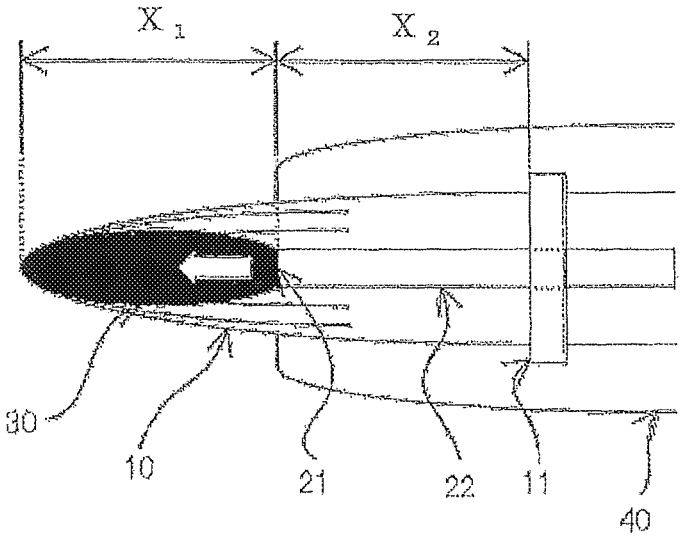
FIG. 2 is a schematic diagram of the embodiment in which a high-viscosity cosmetic fluid is discharged from a discharge port in the brush toward the distal end of the brush tip. This drawing shows a state where the peripheral side of the brush is covered with a front end of the barrel (so-called front barrel) of the cosmetic applicator.

This problem is more common in a cosmetic applicator, for example as shown in FIG. 2, in which the rear part of the brush tip 10 is covered by a so-called front barrel 40. That is, the rear portion $X_2$ of the brush tip 10 covered by the front barrel 40 when contaminated with saliva and the like and kept moist, presents and easily maintains ideal propagation conditions for germs. Here, for example, even if a communication hole that connects the interior in which the rear part of the brush tip 10 is housed and the surface of the front barrel 40 is provided as in Patent Document 2 mentioned in the prior art documents, provision of the small communication hole can only produce very slow evaporation of water, hence the evaporation of water becomes very slow, so that the breeding conditions of germs can be easily maintained depending on the surrounding environment.

For this reason, when the cosmetic applicators having a brush applying part as shown in FIG. 1 or FIG. 2, is used, for example, to store a high-viscosity cosmetic fluid, antibacterial measures need to be taken for the rear portion $X_2$ of the brush tip 10. In the present invention, since antibacterial agents are applied by dipping or the like to the rear portion $X_2$ (behind the discharge port 21) of the brush tip 10, it is possible to suppress the growth of germs and the generation of foul odors.

In this cosmetic applicator brush tip, the total length of the brush tip is X: $X=X_1$ (the length of the front portion of the brush tip)+$X_2$ (the length of the rear portion of the brush tip, or the length behind the discharge port 21). The black portion indicates the cosmetic fluid (lip gloss) 30 discharged from the discharge port 21 into the front portion ($X_1$) of the brush tip 10 and the arrow shows the direction of discharge. Further, a reference numeral 11 denotes a flange for bounding the brush tip 10 by fusing or the like.

Note that $X_2$ (the length of the rear portion of the brush, or the length behind the discharge port 21) varies depending on the utility of the cosmetic applicator, and can be set suitably for various uses (lip gloss, eyeliner, etc.), ranging from 1/1.2 X to ⅓X.

In addition, by making the applied antibacterial agent hardly soluble in the main solvent of the stored cosmetic fluid 30, the antiseptic effect on the discharged cosmetic fluid 30 in the brush tip 10 can also be obtained. Especially if the antibacterial agent is solid at normal temperature, and the antiseptic or antibacterial effect lasts for a long time and this is preferable.

As long as the thus configured cosmetic applicator brush tip of the present invention as described above is formed so that the surface of the rear part ($X_2$) of the brush tip filaments at least behind the discharge port inside the brush or the interior of the resin filaments contains an antibacterial agent by coating or kneading the antibacterial agent, the effect of the invention can be obtained.

In addition, as long as the brush tip contains brush tip filaments (animal fiber and/or resin filaments) coated with the antibacterial agent, in an amount, at least, 0.5% or more, preferably 1 to 100%, more preferably 10 to 100%, and particularly preferably 50 to 100%, to the total amount of the brush tip, the effect of present invention can be obtained.

Further, when the resin filaments containing an antibacterial agent are used, it is desired that the filaments are present in an amount of 0.5% to 100%, preferably 1 to 100%, more preferably 10 to 100%, and particularly preferably 50 to 100%, to the total amount of the brush tip.

(Method of Manufacturing Cosmetic Applicator Brush Tip)

The methods for manufacturing a cosmetic applicator brush tip of the present invention include, for example: (1) a method for manufacturing a brush tip for a cosmetic applicator of animal hair fibers or resin filaments, having antibacterial properties, at least comprising: a step of immersing at least the rear end on the distal direction of the animal hair fibers, or at least the rear end of the resin filaments, in a solution in which an antibacterial agent is dissolved in a solvent capable of dissolving the antibacterial agent; a step of drying and removing the solvent after immersing; and a step of bunching a fiber bundle of the animal hair fibers or the resin filaments from which the solvent has been removed, (2) a method for manufacturing a brush tip for a cosmetic applicator of animal hair fibers or resin filaments, having antibacterial properties, at least comprising: a step of bundling a fiber bundle of the animal hair fibers or the resin filaments to form a brush tip; a step of immersing at least the rear end of the brush tip in a solution in which an antibacterial agent is dissolved in a solvent capable of solving the antibacterial agent; and a step of drying and removing the solvent after immersing, and (3) a method for manufacturing a brush tip for a cosmetic applicator of resin filaments, having antibacterial properties comprising: a step of kneading an antibacterial agent into at least the rear end of the resin filaments; and a step of bundling a fiber bundle of the resin filaments after kneading.

Specifically, the brush tip for a cosmetic applicator having antibacterial properties can be manufactured so as to have the surface of the brush tip filaments formed with an antibacterial agent coating in the rear part ($X_2$ in the drawing) at least behind the discharge port inside the brush tip, by coating the surface of animal hair fibers and/or resin filaments with a solution such as an organic solvent of an antibacterial agent by a method such as dipping or coating, removing the organic solvent or the like by a drying process (natural drying, hot air drying, constant temperature bath, etc., the same applies hereinafter), then bundling with other animal hair fibers and/or resin filaments, or by bundling animal hair fibers and/or resin filaments before coating to prepare a brush tip, coating a solution such as an organic solvent of an antibacterial agent by a method such as dipping or coating the rear end of the brush tip, removing the organic solvent or the like by a drying process.

In the above manufacturing method, it is preferable to use resin filaments having a tapered formed, as described above.

The filament used in the above production may be one in which an antibacterial agent is kneaded in the filament in advance or one in which no antibacterial agent is kneaded. Further, only the filaments kneaded with an antibacterial agent may be bundled, and the rear portion $X_2$ of the aforementioned brush tip (behind the discharge port 21) may be coated with an antibacterial agent.

In the above manufacturing method (3), it is preferable that the step of kneading the antibacterial agent at least in the rear end of the resin filaments is implemented by fusing the resin filaments with the antibacterial agent kneaded therein and resin filaments without an antibacterial agent, with respect to the longitudinal direction, and cutting the fused resin filaments so that the fused part is located at the approximate center. It is also preferable that the step of kneading the antibacterial agent at least in the rear end of the resin filaments is implemented by cutting down the front half of the resin filament with the antibacterial agent kneaded therein, so as to remove the antibacterial agent.

It has been expected that when the thus manufactured brush tip for a cosmetic applicator, that is, the brush tip coated or kneaded in the predetermined portion with the antibacterial agent that is solid in normal temperature, is flexed during using, the antibacterial agent dried and fixed thereon or therein comes off from the filaments. However, such drop-off hardly occurred when the amount of coating and others were specified as above. For example, when the brush tip was not impregnated with a high-viscosity cosmetic fluid or saliva, the antibacterial agent hardly came off even if the brush tip was bent by applying force thereon.

According to the methods for manufacturing a brush for a cosmetic applicator of the present invention configured as above, it is possible to efficiently and easily manufacture the brush tip for a cosmetic applicator having the antibacterial effect, the deodorant effect and the bending resistance.

(Cosmetic Applicators, Etc.)

A cosmetic applicator of the present invention is one having a brush tip, including brush tip filaments and serving as an applying part of the cosmetic applicator having a cosmetic storage for storing a cosmetic fluid, with the rear end of the brush tip attached to the front end of the cosmetic storage, and is characterized in that the brush tip incorporates a discharge port that communicates with the cosmetic storage of the cosmetic applicator, and a coating of an antimicrobial agent is formed on the surface of the brush tip filaments, located at least behind the discharge port inside the brush tip, or in that the brush tip incorporates a discharge port that communicates with the cosmetic storage of the cosmetic applicator, and an antibacterial agent is kneaded with the brush tip filaments, located at least behind the discharge port inside the brush tip so as to make the antibacterial agent contain in the resin filaments.

The cosmetic fluid used in the cosmetic applicator according to the present invention is not particularly limited, and examples include a nail polish composition (a nail liquid), an eye shadow liquid, an eyebrow liquid, a cosmetic liquid for skin coloring, a liquid hair dye, an eye liner liquid, a lip cosmetic liquid (including lip gloss) and the like. The viscosity of the cosmetic fluid 30 varies depending on the type of the cosmetic fluid, but is desirably 50 mPa·s or more as measured at 25° C. at a shear rate of 3.83 $s^{-1}$ by a cone plate viscometer. If the viscosity is less than 50 mPa·s, the cosmetic fluid cannot be retained by the brush tip, so that dripping easily occurs. More preferably, the viscosity is 200 to 10000 mPa·s.

One example of the embodiment of the cosmetic applicator of the present invention will be specifically described with reference to FIG. 3.

Figure 3:
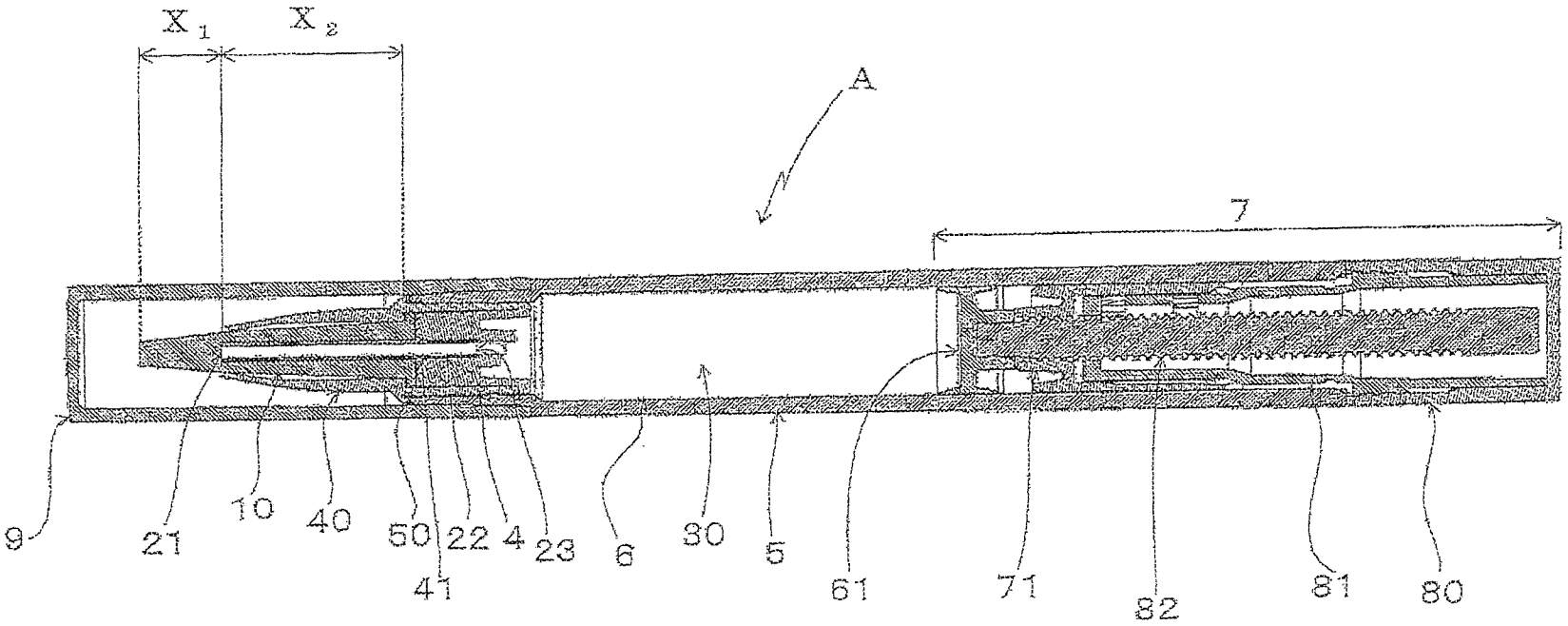
FIG. 3 is a longitudinal section showing an example of an embodiment of a cosmetic applicator of the present invention.

As shown in FIG. 3, in a cosmetic applicator A of the present embodiment, a joint 4 is attached to a front end opening 50 of a barrel cylinder 5. A pipe (corresponding to an inlet hole) 22 is press-fitted and fixed. The purpose of the pipe 22 is to guide the cosmetic fluid 30 in the barrel cylinder 5 (in a tank 6) to the front end of the pipe discharge port 21 through a pipe hole 23 in the pipe 22. The front end of the pipe discharge port 21 is inside the brush tip 10, guides the cosmetic fluid 30 to the desired location in the brush tip 10 so as to supply the cosmetic fluid 30 to the brush tip 10. The outer diameter of the pipe 22 is limited by the size of the brush tip 10, but can be set freely within the limit. The high-viscosity cosmetic fluid 30 to be filled in the liquid tank 6 in the barrel cylinder 5 is selected in consideration of ease of use and the like.

In a fluid propelling unit 7 in FIG. 3, an operational part 80 attached to the rear end of the barrel cylinder 5 is turned relative to the barrel cylinder 5. An advancing part 81 is restricted in the rotational direction with respect to the operational part 80, but is freely slidable in the forward direction of the operational part 80. A threaded shaft 82 is restrained in the rotational direction with respect to the advancing part 81, but can slide freely forward. The threaded shaft 82 is screwed with the threaded part 71, and the threaded part 71 is fixed to the barrel cylinder 5. A piston 61 is attached to the front end of the threaded shaft 82.

In the cosmetic applicator A shown in FIG. 3, the operational part 80 at the rear end of the barrel cylinder 5 is rotated to push the piston 61 forward as described above. Then, the cosmetic fluid 30 in the tank 6 is pushed out, passes through the pipe hole 23, the pipe 22 and the pipe discharge port 21 in this order, and is discharged to the interior of the front portion of the brush tip 10. A measure can be taken such as providing a limiter on the operational part 80 or the like, so that the cosmetic fluid can be discharged from the brush tip 10 in such an amount that the cosmetic fluid does not drip.

It is also possible to prevent dripping by adjusting the viscosity of the cosmetic fluid. Though it depends on the condition of the brush tip, when the above-described brush tip 10 is used, the viscosity is preferably 50 mPa·s or higher when measured at 25° C. at a shear rate 3.83 $s^{-1}$ by a cone plate type viscometer, as described above.

Even when the cosmetic fluid 30 spreads in the front portion ($X_1$) of the brush tip 10 so that the user can determine that the applicator is usable as shown in FIG. 1 or FIG. 2, the cosmetic fluid 30's sufficient spread to the rear part ($X_2$) of the brush tip 10 is hard. Thus, the rear part ($X_2$) of the brush tip 10 does not become sufficiently wet with the cosmetic fluid 30, which is hard to be recognized by the user. Since saliva and the like, adhering due to use, are prone to enter and adhere to the area in the rear part ($X_2$) of the brush tip 10 that is not filled with the cosmetic fluid 30 and also in the gap between the brush tip 10 and the front barrel 40 while the antibacterial agent compounded in the cosmetic fluid has difficulty in producing its effect, the propagation of germs easily occurs. Further, even in a case where an applicator is unused, if its cosmetic fluid solvent contains water and if it is stored in a place where the temperature difference is extreme with its brush tip covered with a protective cap 9, water condensation will occur inside the cap 9 so that water containing no antibacterial agent may fill the inside of the cap 9 and the rear part of the brush tip 10, which also promotes propagation of germs. Herein, the cap 9 is not formed with a vent hole, but the cap 9 may be provided with a vent hole that communicates between the inside and outside of the cap to prevent water condensation or the like.

The brush tip 10 for a cosmetic applicator according to the present embodiment has an antibacterial agent coating (antibacterial agent layer) on the surface of the brush tip filaments in the rear part ($X_2$), hence has an excellent antibacterial effect. In the present embodiment, the outer periphery of the rear part ($X_2$) of the brush tip 10 is covered with the front part of the cosmetic applicator so that dust and floating germs will not enter.

For example, when using an eyeliner applicator that applies the eyeliner liquid to the eyelids, dust or dirt on the eyelids transfers to the applying part and enters the brush tip 10, where germs may grow and produce foul odors. However, in this brush tip 10, the antibacterial agent gradually acts on the contaminated portion and suppresses the growth of various bacteria, thereby obtaining an excellent deodorizing effect.

Since the thus configured cosmetic applicator of the present invention is provided with the brush tip for a cosmetic applicator having the above-described effect, the antibacterial agent can act over time on the portion contaminated with germs in the brush tip and suppress the growth of various bacteria. Thus, the applicator is hygienic even when it is used bit by bit, and has no antibacterial agent coming off, so it is suitable for a cosmetic applicator that is used little by little every day.

EXAMPLES

Next, the present invention will be further described with reference to examples of cosmetic applicator brush tips of the present invention, methods for manufacturing the brush tips, an example of cosmetic applicators with comparative examples. The present invention should not be limited to the following examples.

(Preparation of Cosmetic Fluid: High-Viscosity Lip Gloss, Total Amount 100 Mass %)

titanium mica 0.20 mass %
bengala coated mica titanium 0.43 mass %
ester gum 20.00 mass %
1,3-butylene glycol 2.00 mass %
stearyl glycyrrhetinate 0.20 mass %
tocopherol 0.20 mass %
parabens 0.30 mass %
(palmitic acid/octanoic acid) dextrin 14.00 mass %
diisostearyl malate 20.67 mass %
castor oil 35.00 mass %
safflower oil 7.00 mass %

The above formulation was prepared by wet pulverization using a media mill and mixing and stirring using a dispersion mixer.

The viscosity of the cosmetic fluid was 200 mPa·s when measured at 25° C. at a shear rate of 3.83 $s^{-1}$ using a cone plate viscometer (VISCOMETER TV-20, manufactured by TOKIMEC).

This cosmetic fluid was filled into a cosmetic applicator (UC-18C made by Mitsubishi Pencil, conforming to FIGS. 1 to 3) provided with a brush tip having the following structure, and the cosmetic fluid (lip gloss) was discharged into the brush tip. The initial antibacterial properties of the brush tip, the antibacterial properties of the brush tip for one week after application to the lips, and the presence or absence of the loss of the antibacterial agent when the cosmetic was not ejected were evaluated by the following evaluation methods.

Examples 1 and 2

The rear half ($X_2$: length 14 mm, the same applies hereinafter) of tapered fibers made of 6-nylon fiber (diameter φ50 μm, length 28 mm) was immersed in a 5 mass % solution of methyl paraben (methyl paraoxybenzoate) in ethanol and dried. The preservative-absorbed fibers and normal 6-nylon tapered fibers (diameter φ50 μm, length 28 mm) were mixed at a ratio of 1:1 (number 300 for each), and the rear end was fused to form a flange to produce a brush tip having an outer diameter of 10 mm. A pipe serving as a communication passage was inserted by 14 mm into the brush tip, and then the brush tip was attached to the front part of a UC-18C container. As an example 1, the peripheral portion of the brush tip (indicated by reference numeral 10; the same applies hereinafter) up to the discharge port of the communication passage was covered by a front barrel (indicated by reference numeral 40; the same applies hereinafter), whereas the same brush tip uncovered was provided as an example 2. For both, a cap having a vent hole was put on the cosmetic applicator to be the complete item. The coated amount of the antibacterial agent (preservative) after immersion and drying for each was 3.0 mass % with respect to the total weight of the brush tip.

Examples 3 and 4

After bundling animal hair fibers (squirrel, diameter φ5 μm, length 28 mm, number: 1000), the rear end was bound with a thread, and the rear half was immersed in a 5 mass % solution of 1,2-hexanediol in ethanol and dried to produce a brush tip of the fiber bundle having an outer diameter of 10 mm with the preservative adsorbed thereon. A pipe serving as a communication passage was inserted by 14 mm into the brush tip, and then the brush tip was attached to the front part of a UC-18C container. As an example 3, the peripheral portion of the brush tip up to the discharge port of the communication passage was encased with a front barrel and covered with a cap having a vent hole, whereas the same brush tip covered with a cap having no vent hole was provided as an example 4. The coated amount of the antibacterial agent after immersion and drying for each was 1.0 mass % with respect to the total weight of the brush.

Examples 5 and 6

The rear half of tapered fibers made of polybutylene terephthalate fiber (diameter φ70 μm, length 28 mm, number: 800) was immersed in a Hibitane solution (5% aqueous solution of chlorhexidine gluconate, the same applies hereinafter) and dried. The rear end of the fiber bundle adsorbed with this preservative was fused to form a flange to obtain a brush tip having an outer diameter of 10 mm.

A pipe serving as a communication passage was inserted 14 mm from the rear into the brush tip, and then the brush tip was attached to the front part of a UC-18C container. As an example 5, the peripheral portion of the brush tip up to the discharge port of the communication passage was covered by a front barrel), whereas the same brush tip uncovered was provided as an example 6. For both, a cap having a vent hole was put on. The coated amount of the antibacterial agent (preservative) after immersion and drying for each was 3.0 mass % with respect to the total weight of the brush tip.

Examples 7 and 8

The rear end of tapered fibers made of polybutylene terephthalate fiber (diameter φ00 μm, length 28 mm, number: 500) was fused to form a flange to obtain a brush tip having an outer diameter of 10 mm. The rear half of the fiber bundle was immersed in Hibitane solution and dried. A pipe serving as a communication passage was inserted by 14 mm from the rear into the brush tip with the preservative adsorbed thereon, and the brush tip was then attached to the front part of a UC-18C container. As an example 7, the peripheral portion of the brush tip up to the discharge port of the communication passage was covered with the front barrel, whereas the same brush tip uncovered was provided as an example 8. The coated amount of the antibacterial agent after immersion and drying was 5.0 mass % with respect to the total weight of the brush.

Examples 9 and 10

The rear end of tapered fibers made of polybutylene terephthalate fiber (diameter φ00 μm, length 28 mm, number: 500) was fused to form a flange to obtain a brush tip having an outer diameter of 10 mm. The rear half of this fiber bundle was immersed in a 5 mass % solution of 1,2-hexanediol in ethanol, and then ethanol was evaporated. A pipe serving as a communication passage was inserted by 14 mm into the brush tip with this preservative adsorbed therein, and then the brush tip was attached to the front part of a UC-18C container. As an example 9, the peripheral portion of the brush tip up to the discharge port of the communication passage was encased with a front barrel and covered with a cap having a vent hole, whereas the same brush tip covered with a cap having no vent hole was provided as an example 10. The coated amount of the antibacterial agent (preservative) after immersion and drying for each was 1.0 mass % with respect to the total weight of the brush.

Examples 11 and 12

The rear end of tapered fibers made of polybutylene terephthalate fiber (diameter φ70 μm, length 28 mm, number: 800) was fused to form a flange to obtain a brush tip having an outer diameter of 10 mm. The brush tip as a whole was immersed in a 5 mass % solution of methyl paraben in ethanol and dried. Thus, the brush tip of the fiber bundle adsorbed with the preservative having an outer diameter of 10 mm was obtained. A pipe serving as a communication passage was inserted by 14 mm into the brush tip, and then the brush tip was attached to the front part of a UC-18C container. As an example 11, the peripheral portion of the brush tip up to the discharge port of the communication passage was covered with the front barrel, whereas the same brush tip with the peripheral portion uncovered was provided as an example 12. The coated amount of the antibacterial agent (preservative) after immersion and drying for each was 5 mass % with respect to the total weight of the brush tip.

Examples 13 and 14

The rear end of tapered fibers made of polybutylene terephthalate fiber (diameter φ70 μm, length 28 mm, number: 800) was fused to form a flange to obtain a brush tip having an outer diameter of 10 mm. The rear half of this fiber bundle was immersed in a Hibitane solution and dried. A pipe serving as a communication passage was inserted by 14 mm into the rear end of the brush tip adsorbed with this preservative, and the brush tip was then attached to the front part of a UC-18C container. As an example 13, the peripheral portion of the brush tip up to the discharge port of the communication passage was encased with a front barrel, whereas the same brush tip uncovered with a front barrel was provided as an example 14. For both, the applicator was not provided with a cap to be the complete item. The coated amount of the antibacterial agent (preservative) after immersion and drying for each was 1 mass % with respect to the total weight of the brush.

Examples 15 and 16

Normal polybutylene terephthalate fibers and polybutylene terephthalate fibers kneaded with silver-containing glass are carefully fused so that their cross sections are joined, and the fibers are cut in the same length with the fused part located at the approximate center and with the fibers not containing silver glass being tapered, thus forming a tapered bundle of fibers (diameter φ70 μm, length 28 mm, number: 800).

The end of the fibers containing silver-containing glass was fused to form a flange as the rear end so as to produce a brush tip having an outer diameter of 10 mm. A pipe serving as a communication passage was inserted by 14 mm into a part of the brush tip, and the brush tip was attached to the front part of a UC-18C container.

Another part was immersed in a 5 mass % solution of methyl paraben in ethanol and dried. Thus, a brush tip of a fiber bundle having the preservative adsorbed thereon with an outer diameter of 10 mm was obtained. A pipe serving as a communication passage was inserted by 14 mm into the brush tip, and then the brush tip was attached to the front part of a UC-18C container. For both, the peripheral portion of the brush tip up to the discharge port of the communication passage was covered with a front barrel, and the brush tip was covered with a cap having a vent hole. The brush tip without methyl paraben coating was provided as an example 15, whereas the brush tip with methyl paraben coating was provided as an example 16. The coated amount of the antibacterial agent (preservative) after immersion and drying was 5 mass % with respect to the total weight of the brush tip.

Examples 17 and 18

The front end of polybutylene terephthalate fiber kneaded with silver-containing glass was sharpened by cutting down, and the fibers were cut in the same length, forming a tapered bundle of fibers (diameter φ70 μm, length 28 mm, number: 800). When the magnified image of the surface of the front half of the fibers containing the silver-containing glass was observed, no appearance of the silver-containing glass was observed. The rear end of the fibers containing the silver-containing glass was fused to form a flange to produce a brush tip having an outer diameter of 10 mm. A pipe serving as a communication passage was inserted by 14 mm into a part of the brush tip, and the brush tip was attached to the front part of a UC-18C container. Another part was immersed in a 5 mass % solution of methyl paraben in ethanol and dried. Thus, a brush tip of a fiber bundle having the preservative adsorbed thereon with an outer diameter of 10 mm was obtained. A pipe serving as a communication passage was inserted by 14 mm into the brush tip, and then the brush tip was attached to the front part of a UC-18C container. For both, the peripheral portion of the brush tip up to the discharge port of the communication passage was covered with a front barrel, and the brush tip was covered with a cap having a vent hole. The brush tip without methyl paraben coating was provided as an example 17, whereas the brush tip with methyl paraben coating was provided as an example 18. The coated amount of the antibacterial agent (preservative) after immersion and drying was 5 mass % with respect to the total weight of the brush tip.

Comparative Examples 1 to 4

The 6-nylon tapered fibers of Examples 1 and 2 (diameter φ50 μm, length 28 mm, number: 300) were fused as is at the rear end to produce a brush tip having an outer diameter of 10 mm. A pipe serving as a communication passage was inserted by 14 mm from the rear into the brush tip, and the brush tip was then attached to the front part of a UC-18C container. A comparative example 1 is an applicator where the peripheral portion of the brush tip up to the discharge port of the communication passage was encased by a front barrel and covered with a cap having a vent hole, a comparative example 2 is an applicator where the brush tip was not encased by a front barrel and was covered with a cap having a vent hole; a comparative example 3 is an applicator where the brush tip was encased by a front barrel and covered with a cap having no vent hole; a comparative example 4 is an applicator where the brush tip was not encased by a front barrel and was covered with a cap having no vent hole.

Comparative Examples 5 and 6

The tapered fibers (diameter φ70 μm, length 28 mm, number: 800) made of polybutylene terephthalate of Examples 5 and 6 were fused as is at the rear end to produce a brush tip having an outer diameter of 10 mm. A pipe serving as a communication passage was inserted by 14 mm from the rear into the brush tip, and the brush tip was then attached to the front part of a UC-18C container. A comparative example 5 is an applicator where the peripheral portion of the brush tip up to the discharge port of the communication passage was encased by a front barrel and covered with a cap having a vent hole, and a comparative example 6 is the same applicator covered with a cap having no vent hole.

Comparative Examples 7 and 8

The rear end of tapered fibers made of normal polybutylene terephthalate fiber (diameter φ70 μm, length 28 mm, number: 800) was fused to form a flange to produce a brush tip having an outer diameter of 10 mm. The rear half of this fiber bundle was immersed in a 10 mass % solution of methyl paraben in ethanol and then dried. A pipe serving as a communication passage was inserted by 14 mm from the rear into the brush tip with the preservative adsorbed therein, and the brush tip was then attached to the front part of a UC-18C container. Provided as a comparative Example 7 was an applicator in which the peripheral portion of the brush tip up to the discharge port of the communication passage was encased with a front barrel and covered with a cap having no vent hole. The coated amount of this antibacterial agent (preservative) after immersion and drying was 0.3 mass % with respect to the total weight of the brush tip.

The rear half of the fiber bundle of the comparative example 7 was immersed in a 20 mass % solution of methylparaben in ethanol and then dried. The coated amount of this antibacterial agent (preservative) after immersion and drying was 0.1 mass % with respect to the total weight of the brush tip.

[Evaluation on Initial Antibacterial Properties of Brush Tips (Antibacterial Properties after a Lapse of One Week without Use)]

In a clean room, a lip gloss contained in each of the cosmetic applicators of examples 1 to 18 and comparative examples 1 to 8 was discharged to such an extent that the lip gloss puddled in the brush tip. The applicators (all capped except the comparative examples 1 and 2) were left in a 25° C., 65% constant temperature and humidity chamber for one week, and then the lip gloss fluid of the brush tip was dropped on a medium (SCDA medium) to perform a bacterial challenge test (test conforming to ISO11930: 2012).

In examples 1 to 3, 5 to 9, 11 to 14, 16 and 18 and comparative examples 7 and 8, all bacteria were killed in the culture medium one week after the dropping and in examples 4, 10, 15 and 17, bacteria almost died, whereas in comparative examples 1, 2 and 6, the bacteria were partially killed and there existed a liquid (lip gloss solution) having partially lost the preservative effect in the brush tip. In comparative examples 3 to 5, it was found that no bacteria were killed and there existed a liquid (lip gloss liquid) having no preservative effect in the brush tip.

(Antibacterial Properties of the Brush Tip for One Week after Use)

The cosmetic applicators whose lip gloss liquid had been dispensed in the above evaluation on initial antibacterial properties, were used for sometime by 10 testers, and the applicators (all capped except the examples 13 and 14) were left in a 25° C., 65% constant temperature and humidity chamber for one week, and the odor of the brush tips was checked.

In examples 1 to 3, 5 to 9, 11 to 14, 16 and 18, and comparative examples 7 and 8, no odor was felt, and in examples 4, 10, 15 and 17, almost no odor was noticed. In comparative examples 1, 2, and 6, a weak off-odor was felt, and in comparative examples 3 to 5, a strong foul odor was felt.

(Drop Test of Antibacterial Agent)

For each of the brush tips of examples 1 to 18 and comparative examples 7 and 8, with the brush tip held at its rear end, the front end of the brush tip was pressed and pushed down completely against a sheet of black paper placed horizontally. Then, the paper surface was observed to check whether there was any loss of the antibacterial agent. In examples 2, 6, 8, 10, 12, 14, 17 and 18, fine powders of antibacterial agents were slightly observed. In the comparative example 7, almost all the antibacterial agent came off as methylparaben powder. In comparative example 8, a greater amount than that of comparative example 7 came off.

(Condensation in the Cap after One Week in 24 Hour Cyclic Test with a Variation of −10° C. to 40° C.)

Samples other than those of examples 14 and 15 were left in a thermostat changing from −10° C. to 40° C. in a cycle of 24 hours for one week, and then the condition of water condensation in the cap was observed. Condensation was observed in the samples covered with the caps having no vent holes, i.e., in examples 1, 2, 4, 7, 8 and 10, and comparative examples 3 to 5, 7, and 8.

In total consideration of the above results of the initial antibacterial properties of the brush tip, the antibacterial properties of the brush tip one week after application to the lips, and the loss of the antibacterial agent when the cosmetic material was not dispensed, it was confirmed in examples 1 to 18 which fall within the scope of the present invention, that without regard to what the fiber material is made of, such as a resin filament, animal hair and the like, the brush tip for a cosmetic applicator that is excellent in bending resistance, can be kept sanitary so that various bacteria will not multiply in places where no application fluid has permeated in the brush tip, and where prevention of loss of antibacterial agent can be obtained as well as the method for manufacturing the same and the cosmetic applicator using the same.

EXPLANATION OF SYMBOLS

A cosmetic applicator
10 brush tip
11 flange
21 discharge port
22 pipe
23 inside pipe hole
30 lip gloss fluid
4 joint
40 front barrel
41 inside diameter on the front side of the joint
5 barrel cylinder
50 front opening of the barrel cylinder
6 tank
61 piston
7 liquid propelling unit
71 threaded part
80 operational part
81 advancing part
82 threaded shaft
9 cap
X total length of the brush tip
$X_1$ front part of the brush tip
$X_2$ rear part of the brush tip

What is claimed is:

1. A brush tip configured to serve as an applying part of a cosmetic applicator having a cosmetic storage for storing a cosmetic fluid the brush tip comprising:
- a bundle of brush tip filaments;
- a discharge port that communicates with the cosmetic storage of the cosmetic applicator, the discharge port being located inside the bundle of brush tip filaments; and
- a coating of an antimicrobial agent that is formed on a surface of the brush tip filaments, located only behind the discharge port, by only drying the surface after immersing the surface in the antimicrobial agent.

2. The brush tip for a cosmetic applicator according to claim 1, wherein the antibacterial agent is contained in the brush tip filaments.

3. The brush tip according to claim 1, wherein the antimicrobial agent is solid at 25° C.

4. A brush tip configured to serve as an applying part of a cosmetic applicator having a cosmetic storage for storing a cosmetic fluid, comprising:
- a bundle of brush tip resin filaments; and
- a discharge port that communicates with the cosmetic storage of the cosmetic applicator, the discharge port being located inside the bundle of brush tip resin filaments;
- wherein the brush tip resin filaments contain an antibacterial agent, only behind the discharge port, by kneading the antimicrobial agent in the brush tip resin filaments only behind the discharge port.

5. A cosmetic applicator comprising:
- a brush tip including brush tip filaments and serving as an applying part of the cosmetic applicator; and
- a cosmetic storage;
- wherein a rear end of the brush tip is attached to the front end of the cosmetic storage,
- wherein the brush tip incorporates a discharge port that communicates with the cosmetic storage of the cosmetic applicator, and
- wherein a coating of an antimicrobial agent is formed on a surface of the brush tip filaments, located only behind the discharge port inside the brush tip.

6. The cosmetic applicator according to claim 5, further comprising: a cosmetic fluid stored in the cosmetic applicator, wherein a viscosity of the cosmetic fluid is 50 mPa·s or more as measured at 25° C. at a shear rate of 3.83 $s^{-1}$ by a cone plate viscometer.

7. The cosmetic applicator according to claim 5, wherein the brush tip of the applying part of the cosmetic applicator is covered with a cap.

8. The cosmetic applicator according to claim 7, wherein the cap includes a vent communicating between an inside of the cap and an outside of the cap.

9. The cosmetic applicator according to claim 4, wherein an outer periphery of a rear part of the brush tip is covered by a front end part of the cosmetic applicator.

10. A cosmetic applicator comprising:
- a brush tip including brush tip resin filaments and serving as an applying part of the cosmetic applicator; and
- a cosmetic storage for storing a cosmetic fluid, wherein a rear end of the brush tip is attached to the front end of the cosmetic storage, wherein the brush tip incorporates a discharge port that communicates with the cosmetic storage of the cosmetic applicator, and wherein the brush tip resin filaments contain an antibacterial agent, located only behind the discharge port, by kneading the antibacterial agent in the brush tip resin filaments only behind the discharge port.

11. A manufacturing method of a brush tip for a cosmetic applicator of animal hair fibers or resin filaments, having an antibacterial property, wherein:

the brush tip incorporates a discharge port of a cosmetic fluid, and the brush tip includes a rear portion located behind the discharge port, the manufacturing method comprising:

a step of immersing only the rear portion of the animal hair fibers, or only the rear portion of the resin filaments, in a solution in which an antibacterial agent is dissolved in a solvent capable of dissolving the antibacterial agent;

a step of drying and removing the solvent after immersing;

a step of bunching the animal hair fibers or the resin filaments from which the solvent has been removed, into a fiber bundle; and a step of forming the discharge port into the fiber bundle.

12. A manufacturing method of a brush tip for a cosmetic applicator, wherein at least a front end of the resin filament according to claim 11, is tapered.

13. The manufacturing method of the brush tip for the cosmetic applicator according to claim 11, wherein the antibacterial agent is solid at 25° C.

14. A manufacturing method of a brush tip for a cosmetic applicator of animal hair fibers or resin filaments, having an antibacterial property, wherein:

the brush tip incorporates a discharge port of a cosmetic fluid, and the brush tip includes a rear portion located behind the discharge port, the manufacturing method comprising:

a step of bundling a fiber bundle of the animal hair fibers or the resin filaments to form the brush tip;

a step of immersing only the rear portion of the brush tip in a solution in which an antibacterial agent is dissolved in a solvent capable of dissolving the antibacterial agent;

a step of drying and removing the solvent after immersing, and a step of forming the discharge port into the brush tip from which the solvent was removed.

15. A manufacturing method of a brush tip for a cosmetic applicator of resin filaments, having an antibacterial property, wherein:

the brush tip incorporates a discharge port of a cosmetic fluid, and the brush tip includes a rear portion located behind the discharge port, the manufacturing method comprising:

a step of kneading an antibacterial agent only in the rear portion of the resin filaments forming the rear portion of the brush tip;

a step of bundling the resin filaments after kneading into a fiber bundle; and a step of forming the discharge port into the fiber bundle.

16. The manufacturing method of a brush tip for a cosmetic applicator, having antibacterial properties according to claim 15, wherein the step of kneading the antibacterial agent only in the rear portion of the resin filaments is implemented by fusing the resin filaments with the antibacterial agent kneaded therein and resin filaments without an antibacterial agent, with respect to a longitudinal direction, and cutting the fused resin filaments so that a fused part is located at a center.

17. The manufacturing method of a brush tip for a cosmetic applicator, having antibacterial properties according to claim 15, wherein the step of kneading the antibacterial agent only in the rear portion of the resin filaments is implemented by cutting down a front half of the resin filament with the antibacterial agent kneaded therein, so as to remove the antibacterial agent.

* * * * *